US007240961B2

(12) United States Patent
Grace

(10) Patent No.: US 7,240,961 B2
(45) Date of Patent: Jul. 10, 2007

(54) PORTABLE SLING CHAIR

(76) Inventor: Daniel R. Grace, 4 Beach Rd., Old Saybrook, CT (US) 06475

( * ) Notice: Subject to any disclaimer, the term of this patent is extended or adjusted under 35 U.S.C. 154(b) by 0 days.

(21) Appl. No.: 11/203,795

(22) Filed: Aug. 15, 2005

(65) Prior Publication Data

US 2006/0061146 A1 Mar. 23, 2006

Related U.S. Application Data

(60) Provisional application No. 60/601,282, filed on Aug. 13, 2004.

(51) Int. Cl.
*A47C 4/28* (2006.01)
*A47C 4/00* (2006.01)
*A47C 7/02* (2006.01)

(52) U.S. Cl. ..... 297/45; 297/16.2; 297/17; 297/452.13; 297/452.56

(58) Field of Classification Search ..... 297/45, 297/16.2, 17, 452.13, 452.56
See application file for complete search history.

(56) References Cited

U.S. PATENT DOCUMENTS 1,341,689 A * 6/1920 Walmsley ..... 297/17
2,689,603 A * 9/1954 Smith ..... 297/452.13 X
2,712,349 A * 7/1955 Le Voir ..... 297/452.13 X
3,593,352 A 7/1971 Britt
4,047,752 A * 9/1977 Rohr ..... 297/452.13 X
4,258,951 A 3/1981 Groom
4,605,261 A 8/1986 Lee
4,671,566 A 6/1987 Knapp et al.
4,673,211 A 6/1987 Hoffman
D295,242 S 4/1988 Frick et al.
4,797,961 A 1/1989 Pasquariello
4,836,601 A * 6/1989 Cone ..... 297/16.2
4,925,138 A 5/1990 Rawlins
4,947,497 A 8/1990 Marchand
5,054,849 A * 10/1991 Hoff ..... 297/45
5,362,130 A * 11/1994 Hoffman ..... 297/45 X
5,499,857 A * 3/1996 Lynch, Jr. ..... 297/16.2

(Continued)

FOREIGN PATENT DOCUMENTS

EP 139306 A1 * 5/1985 ..... 297/45

(Continued)

*Primary Examiner*—Rodney B. White
(74) *Attorney, Agent, or Firm*—McCormick, Paulding & Huber LLP

(57) ABSTRACT

A portable sling chair having a frame formed by a plurality of rigid axially elongated collapsible tubular frame members including a main frame member and a rear frame member connected for pivotal and axial sliding movement relative to each other, a collapsible front support member, a collapsible frame front support assembly, a collapsible frame rear support assembly, and at least one connecting member connecting the main frame member and the rear frame member to maintain the frame in a substantially static condition when the frame is resting on a supporting surface in setup condition. A rectangular panel made from flexible material is supported at its opposite ends by collapsible front and rear panel support members, extends therebetween, and defines contiguous chair seat and back portions when the frame is in its setup condition. All of the frame members are disposed in generally side-by-side relation to each other in the collapsed condition of the frame and form a compact bundle.

25 Claims, 14 Drawing Sheets

U.S. PATENT DOCUMENTS 5,718,473 A * 2/1998 Lynch, Jr. ..... 297/16.2
6,328,131 B1 12/2001 Backus
6,698,827 B2 * 3/2004 Le Gette et al. ..... 297/16.2
6,820,927 B2 * 11/2004 Isom et al. ..... 297/16.2
6,926,355 B2 * 8/2005 Le Gette et al. ..... 297/16.2

FOREIGN PATENT DOCUMENTS

GB 2 025 213 1/1980

* cited by examiner

PORTABLE SLING CHAIR

CROSS REFERENCE TO RELATED APPLICATION

This application relates to Provisional U.S. patent application Ser. No. 60/601,282 filed Aug. 13, 2004, the filing date of which is hereby claimed and which application is hereby adopted by reference as part of the present disclosure.

FIELD OF THE INVENTION

This invention relates in general to seats and chairs and deals more particularly with improvements in portable sling chairs.

BACKGROUND OF THE INVENTION

There was a time when a hiker or camper traveling on foot and seeking respite would look for a nearby "comfortable" rock or fallen tree upon which to sit. However, in the current era of creature comforts those seeking to enjoy the beauties of nature and the great outdoors are often reluctant to give up the basic comforts of home and will more than likely carry with them some form of seating device. The advent of durable lightweight materials has made it feasible to carry a foldable or otherwise collapsible chair or seat in a backpack and has created in ever increasing demand for improved portable chairs and seats. Consumers—more than ever—are thinking comfort in the great outdoors. Those light weight seating devices heretofore available and which are suitable for portage in a backpack most often take the form of a seat or stool which lacks provision for back support. Seating devices which do provide back support and enable a user to obtain a comfortable reclining position often include a foldable relatively cumbersome frame structure. Those which collapse to form a somewhat smaller and less cumbersome package usually includes a relatively large number of frame elements which require time consuming individual manual manipulation during setup and break down and are troublesome and time consuming to erect and break down.

Accordingly, it is the generally aim of the present invention to provide portable, light-weight, durable sling chairs which may be readily broken down to form compact bundle and which may be rapidly set up for use and collapsed for portage or storage with minimal effort.

SUMMARY OF THE INVENTION

In accordance with the present invention, a portable sling chair has a frame having setup and collapsed conditions and including a plurality of axially elongated rigid frame members. The frame includes a single main frame member and a rear frame member. The rear end of the main frame member is secured to the rear frame member by a connecting fitting for pivotal movement of the main frame member toward and away from the rear frame member and for movement longitudinally along the rear frame member. A connecting means is provided for releasably securing the connecting fitting in a predetermined setup position on the rear frame member and with the connecting fitting longitudinally downwardly spaced from the upper end of the rear frame member is provided to secure the chair frame in its setup condition. The rear frame member is upwardly and forwardly inclined and the main frame member is rearwardly and upwardly inclined when the chair is resting on a generally horizontal supporting surface in its setup condition. An axially elongated connecting element connected to the main frame member and to the rear frame member restrains the main frame member against pivotal movement away from the rear frame member when the chair is in its setup condition. A flexible panel supported on the chair frame at the upper end of the rear frame member and at the forward end of the main frame member is disposed above the main frame member and defines contiguous chair seat and back portions.

DETAILED DESCRIPTIONS OF PREFERRED EMBODIMENTS

Figure 1:
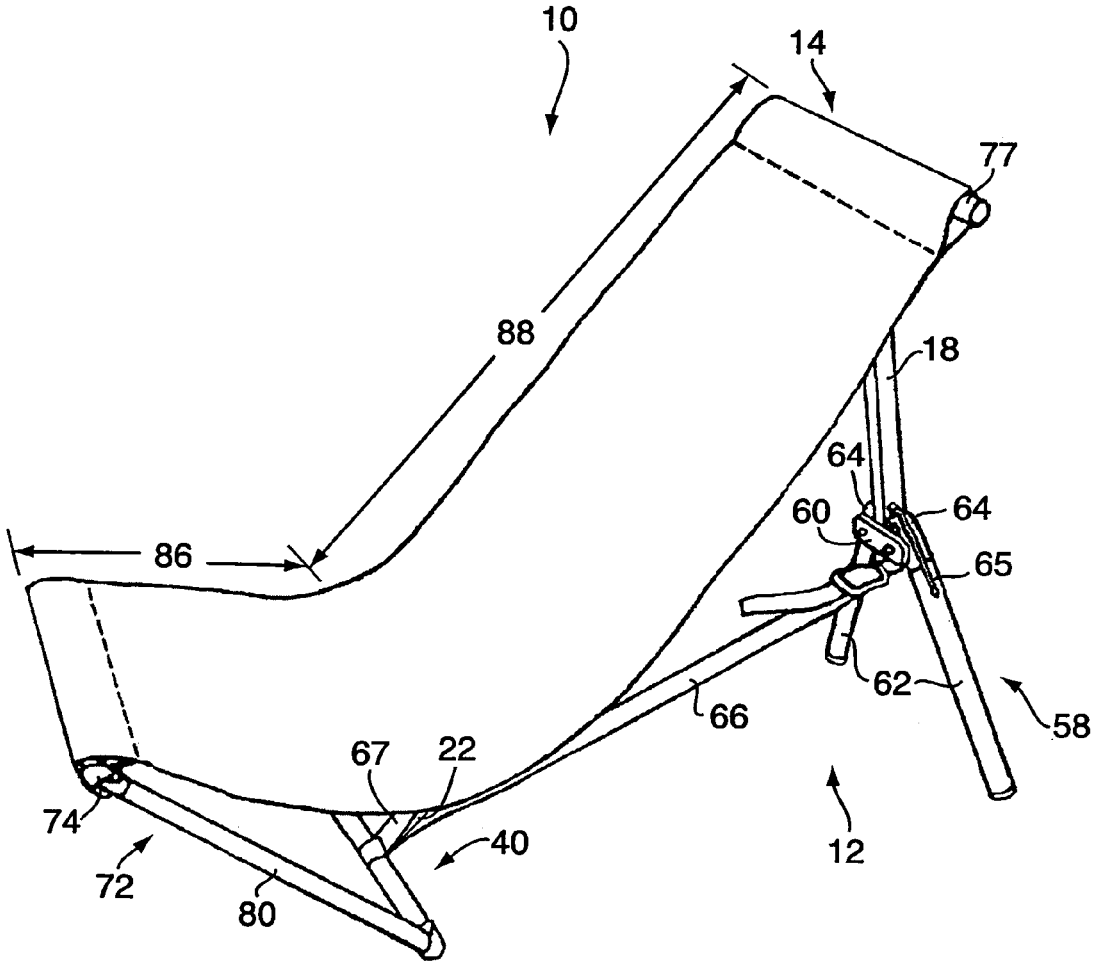
FIG. 1 is a perspective view of a portable sling chair embodying the present invention.

In the drawings, a portable sling chair embodying the present invention is indicated generally by the reference numeral 10. The illustrated chair 10 essentially comprises a chair frame designated generally by the numeral 12 and having setup and knocked down conditions and a flexible panel or sling indicated generally at 14 supported at its opposite ends on the chair frame to hang loosely from the frame and define contiguous chair seat and back portions when the chair is in setup condition ready for use. In the further description which follows, the chair 10 is initially described in setup condition as it appears in FIGS. 1 and 2. Terms such as front, rear, upper and lower are employed in the further description which follows and refer to the chair 10 in its setup condition of FIGS. 1 and 2. Considering first the frame 12 in further detail and referring to particularly FIG. 3, where the frame is shown in setup condition with the panel or sling 14 removed therefrom, the frame comprises a plurality of axially elongated rigid frame members preferably made from durable light-weight tubular metal, aluminum being presently preferred.

The illustrated chair frame 12 essentially comprises an axially elongated telescopically collapsible tubular main frame member or spine, indicated generally at 16, and having a generally rectangular cross section, and an axially elongated rear frame member 18, the cross section of which is also generally rectangular for a reason which will be hereinafter evident.

The main frame member 16 is formed by first and second tubular frame sections of differing size, indicated at 20 and 22, respectively. The second section 22 is slidably telescopically received within the first section 20 in a retracted position and is movable relative to the first section to an extended position wherein the second section projects a substantial distance from and beyond the first section. A manually-operable spring detent button assembly, indicated generally at 24 in FIG. 2, carried by and disposed within the second or smaller of the two frame sections includes a detent button 26 biased outwardly through an opening in the lower wall of the second section and which engages a complementary aperture which opens through an associated lower wall of the first or larger section 20 to releasably lock the two frame sections in the extended position relative to each other when the chair is in its setup condition.

In FIGS. 4–7 the spring detent button assembly 24 and the manner in which it cooperates with the main frame member 16 to releasably retain the latter member in its extended position is illustrated in some detail. In addition to the button 26, which is preferably fabricated from metal, the assembly 24 also includes a spring housing 28, a spring housing end cap 30, each preferably molded from durable plastic, and a compression or coil spring 32. The spring housing is sized to complement at least a portion of the rectangular bore in the tubular second member 22 in which it is received. A flanged inner end of the generally cylindrical button 26 normally bears upon the spring housing 28. The spring 32 acts between the button 26 and the housing end cap 30 which is slidably received within a cylindrical spring housing bore 21. A projection or dimple 34 on the housing end cap 30 is biased into a complementary opening 35 in a wall of the second member 22 axially opposite the cylindrical button 26. Thus, the spring biased button 26 and the dimple 34 cooperate to secure the detent button assembly 24 in assembly with and within the second frame section 22. The domed outer or free end of the button 26 provides a cam surface for cooperating with an associated edge of the first frame section 20 when the button is manually depressed toward releasing position and the second frame section 22 is simultaneously moved into the first frame section 20 and toward its retracted position. Since the two tubular frame sections 20 and 22 which comprise the main frame member 16 are of rectangular cross section, the detent button 26 carried by the second or smaller of the two sections will at all times be maintained in proper alignment with the button receiving aperture in the first or larger of the two tubular sections whereby the second frame section 22 will be automatically secured in its extended position by the button 26 when moved to the latter position.

Figure 3:
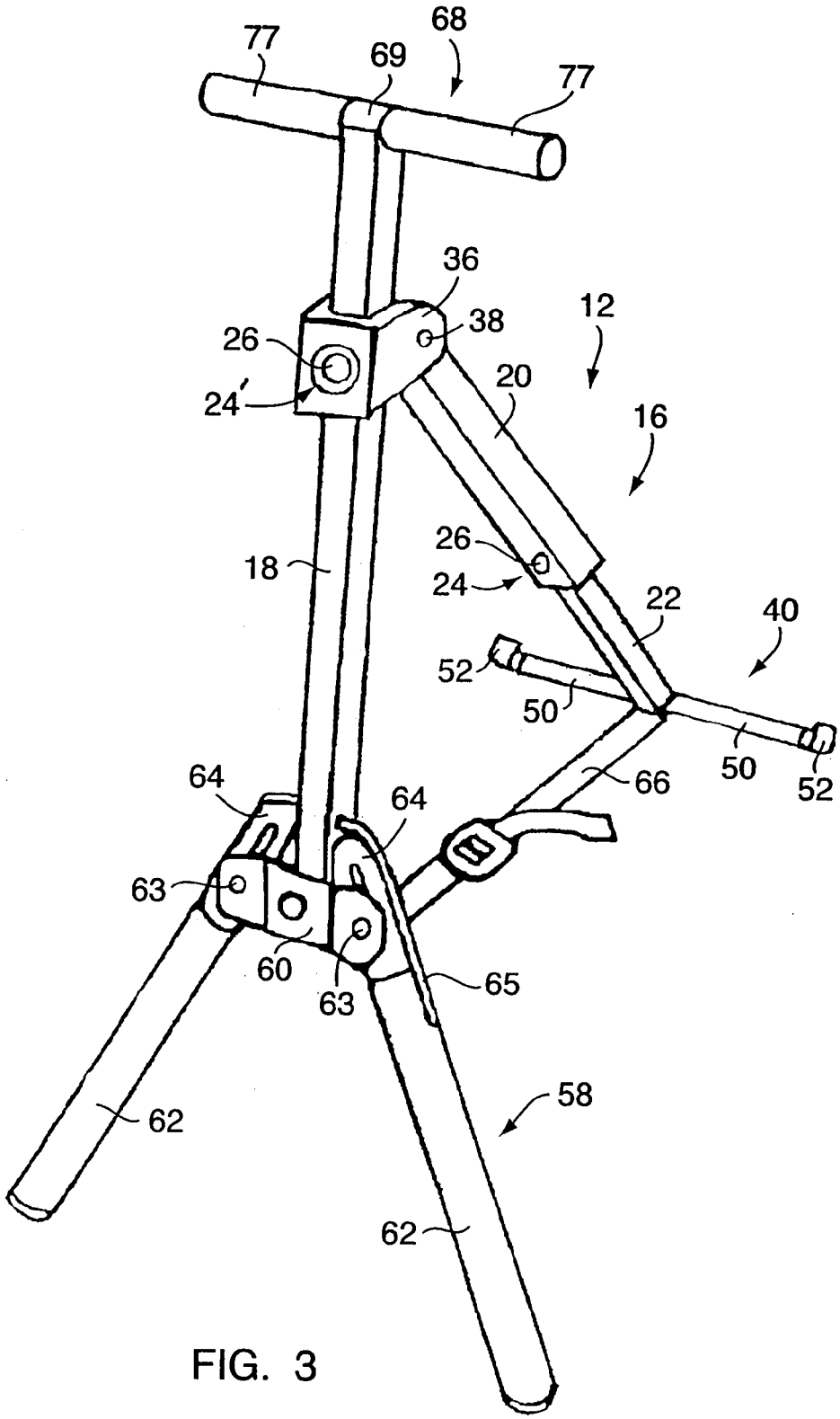
FIG. 3 is a perspective view of the chair frame shown with the sling and sling front support member removed therefrom.
Figure 4:
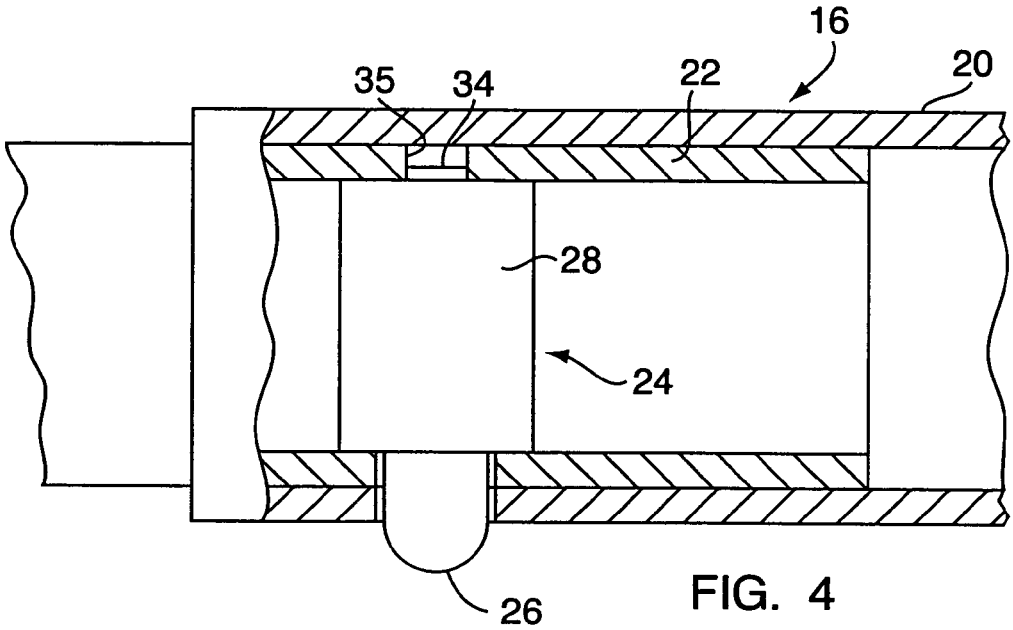
FIG. 4 is a somewhat enlarged fragmentary axial sectional view through the telescopic main frame member showing the spring/button detent assembly therein.
Figure 5:
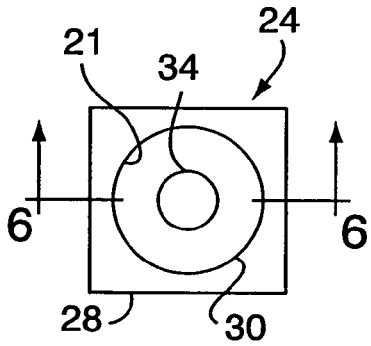
FIG. 5 is a top plan view of the spring/button detent assembly.
Figure 7:
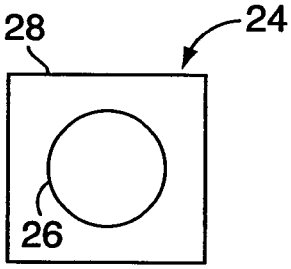
FIG. 7 is a bottom plan view of the spring/button detent assembly.
Figure 6:
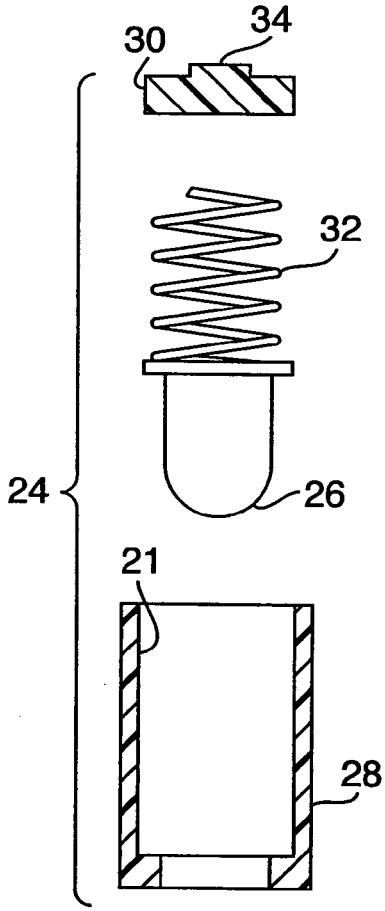
FIG. 6 is an exploded sectional view taken along the line 6—6 of FIG. 5.

The main frame member 16 is connected at its rear end to the rear frame member 18 by a fitting or collar 36 which is received on and adapted to slide in one and in an opposite direction along an upper portion of the rear frame member 18. The collar 36 has an integral forwardly open yoke which receives the rear end of the main frame member 16. The rear end of the main frame member is pivotally secured to the yoke by a pivot pin 38. Thus, the main frame member 16 is secured to the rear frame member 18 for axial sliding movement along and relative to the rear frame member and for limited rearward pivotal movement toward and limited forward pivotal movement away from the rear frame member. The main frame member 16 is maintained in alignment with the rear frame member 18 for forward and rearward pivotal movement by the collar 36 which complements the rectangular cross-sectional configuration of the rear frame member 18 upon which it is received. Another manually-operably spring biased detent button assembly 24' disposed within and carried by the rear frame member 18 projects through and beyond an aperture which opens through the rear wall of the rear frame member 18 to engage within an aperture in the collar 36 as best shown in FIG. 3. Thus, the collar 36 is releasably retained by the detent button assembly 24' in a predetermined position on the rear frame member 18 downwardly spaced from the upper end of the rear frame member. It should now be apparent that the main frame member and the rear frame member are connected to each other for articulated movement relative to each other within a common axial plane.

Figure 8:
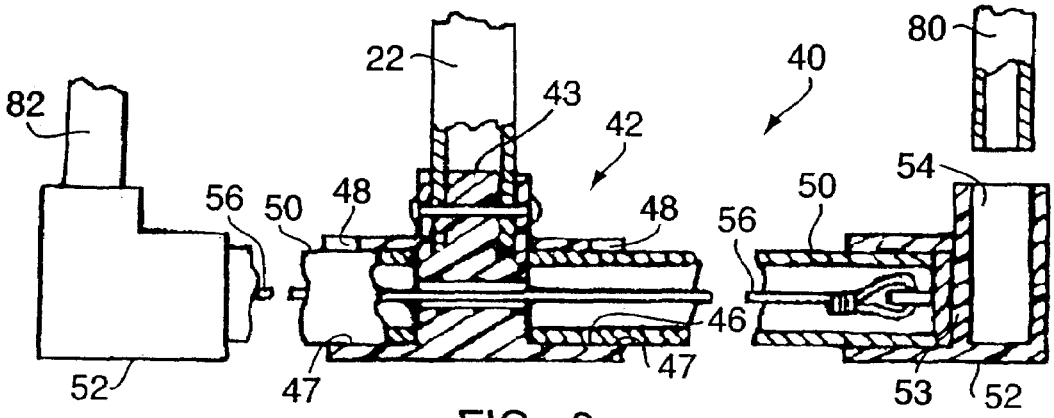
FIG. 8 is a somewhat enlarged fragmentary front elevational view of the collapsible front support assembly shown partially in axial section.
Figure 9:
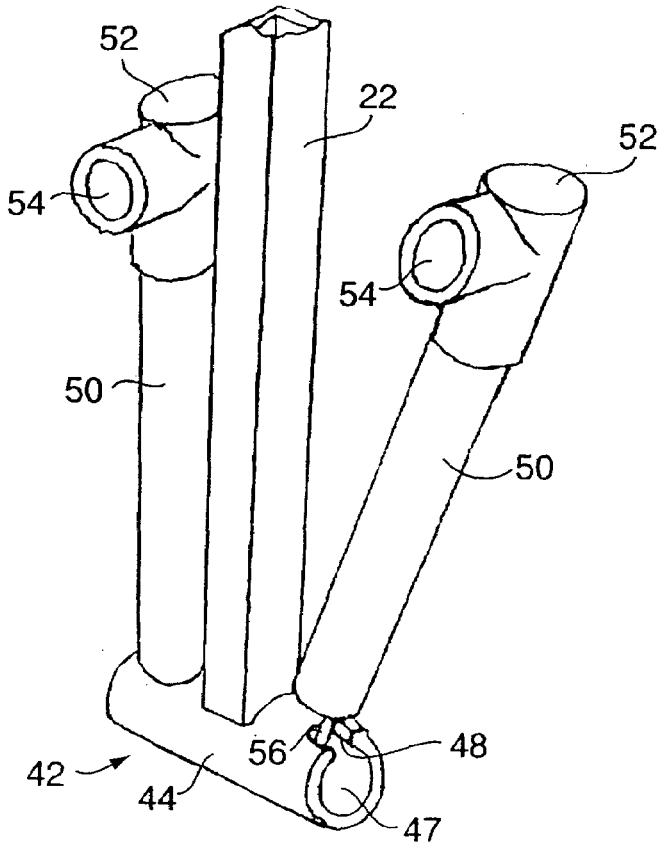
FIG. 9 is a somewhat further enlarged fragmentary perspective view of the front support assembly in a partially collapsed condition.

The chair frame 12, which includes the main frame member 16 and the rear frame member 18 is supported on the ground or other suitable horizontal supporting surface by a collapsible front support assembly or cross member indicated generally at 40 and mounted at the forward end of the main frame member 16. More specifically, the main frame member 16 has a tee fitting indicated generally at 42 secured at the its forward end as best shown in FIGS. 8 and 9. Like the previously described collar 36 and other connecting fittings hereinafter described, the tee fitting 42 is preferably molded from a durable lightweight plastic material. The tee fitting 42 has a stem portion 43 which is received within and complements a forward end portion of the rectangular tubular main frame member 16. A cross head portion of the tee fitting 42, indicated at 44, is generally cylindrical, projects laterally outwardly beyond the opposite sides of the main frame member 16 and has a stepped bore 46 extending coaxially through it. Diametrically enlarged outer end portions of the bore 46 define axially outwardly open sockets 47, 47. Slots 48, 48 formed in the cross head portion 44, communicate with the sockets 47, 47 and open outwardly through opposite ends of the cross head portion 44 and rearwardly in the direction of the rear end of the main frame member 16, for a purpose which will be hereinafter evident. The front cross member 40 further includes a pair of substantially identical cylindrical tubular section members 50, 50. An inner end of each section member 50 is slidably received within a respectively associated laterally outwardly open cylindrical socket 47. The front cross member 40 further includes a pair of 90 degree elbow fittings 52, 52.

Each elbow fitting 52 is mounted in fixed position on the outer end of a respectively associated section member 50 and has a generally upwardly open socket 54. An elastomeric bungee cord 56 extends through the bore 46, through the section members 50, 50, and is connected at its opposite ends to section member end plugs 53, 53 (one shown in FIG. 8) located within the elbow fittings 52, 52. The bungee cord continuously urges the elbow fittings 52, 52 and the section members 50, 50 inwardly and toward the tee fitting 42 to maintain the section members in connected engagement with the tee fitting 42. The further purpose of the elbow fittings 52, 52 will be hereinafter further discussed.

Figure 10:
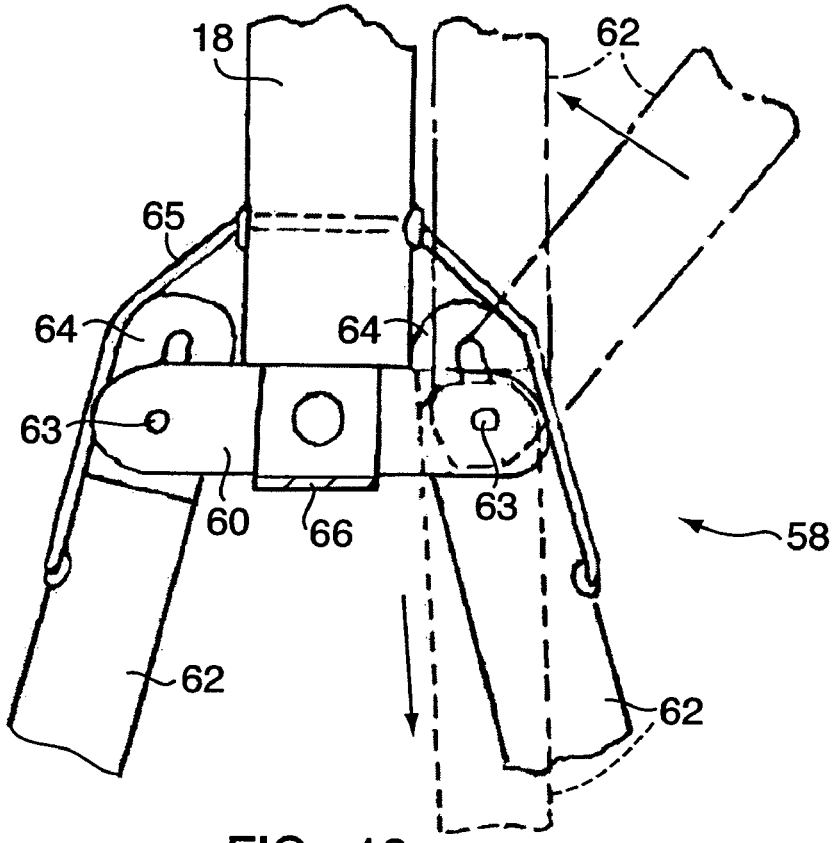
FIG. 10 is a somewhat enlarged fragmentary rear elevational view of the collapsible rear leg assembly.

The rear frame member 18 is preferably supported on the ground or on a suitable horizontally disposed supporting surface by a collapsible rear support assembly or leg assembly indicated generally at 58 and best shown in FIGS. 3 and 10. The leg assembly 58 includes a leg yoke fitting 60 secured by a central rivet or otherwise mounted in fixed position on the lower end of the rear frame member 18, as best shown in FIGS. 3 and 10. The leg yoke fitting 60 has a pair of yokes which open laterally outward at opposite sides of the rear frame member 18. A cylindrical leg 62 is connected to each yoke by an associated slotted leg connecting fitting 64 which plugs into the upper end of each cylindrical tubular leg and is permanently secured to that leg. When the collapsible legs 62, 62 are deployed in setup position, as shown in FIGS. 3 and 10, each leg is downwardly and laterally outwardly inclined at an angle of approximately 15 degrees to the vertical. Pivot pins 63, 63 carried by the yokes pass through the slots in the leg connecting fittings, 64, 64 and are disposed in the lower ends of the slots so that the upper end of each leg connecting fitting 64 bears against an associated side of the rear frame member 18 when the legs 62, 62 are deployed. A length of elastomeric shock cord or bungee cord 65 secured to the legs 62, 62 below the pivot pins 63, 63 connect the legs and passes over the upper ends of the leg connecting fittings 64, 64 and through grommetted apertures in opposite sides of the rear frame member 18. The bungee cord 65, which is in tension when the legs are deployed in setup condition, biases the legs toward deployed position and maintains the legs in deployed or setup condition while allowing the legs to be manually moved to and positioned in collapsed or break down condition as will be hereinafter discussed.

At least one flexible connecting member or strap 66 is secured to and extends between the main frame member 16 and the rear frame member 18 to prevent excessive pivotal movement of the main frame member 16 in a forward direction and away from the rear frame member 18. The flexible member 66 (FIGS. 1-3) is preferably of adjustable length and disposed below the main frame member 16. A second flexible connecting member or strap 67 of adjustable length is or may be attached to the chair frame 12 to extend between the upper end of the rear frame member 18 and a front end portion of the main frame member 16. The additional flexible member 67 (FIG. 2) cooperates with the flexible member 66 to aid in maintaining the chair frame in a static condition when the chair is in use.

Figure 11:
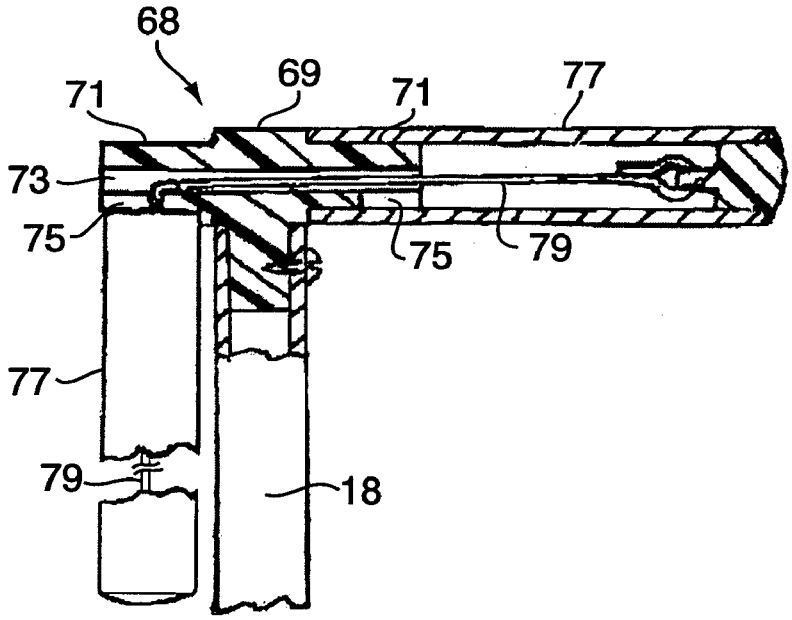
FIG. 11 is similar to FIG. 8 but shows the collapsible sling upper support member.
Figure 12:
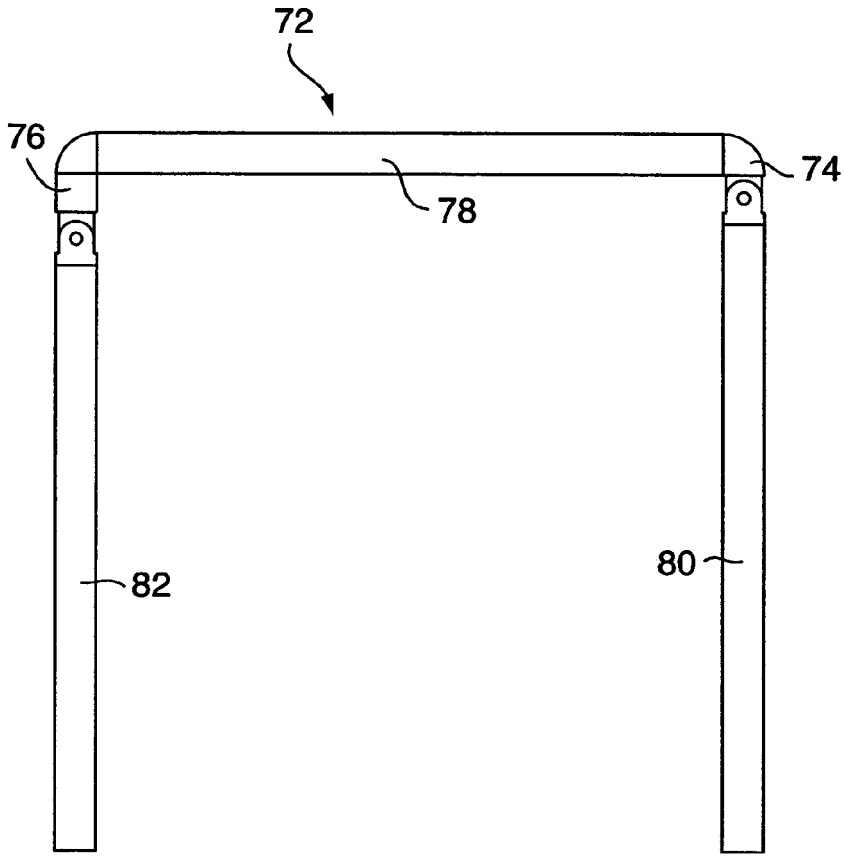
FIG. 12 is a somewhat enlarged front elevational view of the sling front support member.
Figure 13:
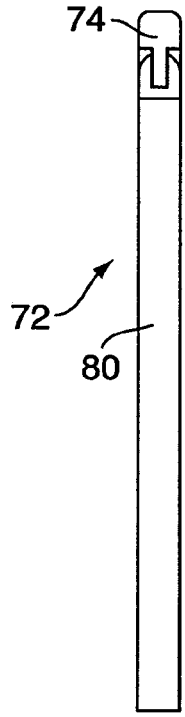
FIG. 13 is a side elevational view of the sling front support member.

The flexible panel or sling 14 and the manner in which it is supported on the frame 12 will now be considered. Support for the upper rear end portion of the panel 14 is provided by a collapsible panel upper support member, indicated generally at 68 in FIG. 11 and mounted on the upper end of the rear frame member 18. The collapsible panel upper support member 68 is similar in many respects to the collapsible front cross member 40 hereinbefore described in that it includes a tee fitting 69 which has stem portion which in this instance is mounted in fixed position within the upper end of the tubular rear support member 18. A cross-head portion of the tee fitting 69, indicated at 71, is generally cylindrical, projects laterally outwardly beyond opposite sides of the rear frame member and has a bore 73 extending coaxially through it. Slots 75, 75 formed in the cross head 71 (one shown) communicates with the bore 73 and open outwardly through opposite ends of the cross head and in a general downward direction. The cross head carries a pair of substantial identical cylindrical tubular panel support member 77, 77. Each member 77 is slidably received in an associated outwardly projecting cylindrical end portion of the cross head 71. The panel support members are maintained in assembled or setup position with the tee fitting 69 by a length of elastomeric shock cord or bungee chord 79 which extends through the bore 73, through the panel support members 77, 77, and is connected at its opposite ends to a pair of end caps received in the outer ends of the support members 77, 77. The bungee cord 79 also functions to bias each panel support member toward a knocked down position wherein the inner end of the panel support member is seated on the surface of an associated end portion of the cross head 71. In FIG. 11, one of the panel support members 77, 77 is shown in its setup position whereas the other of the panel support members is shown resting on the cross head in its knocked down condition. The forward end of the sling 14 is supported by a sling front support member 72, best shown in FIGS. 12–14, which comprises an inverted generally "U" shaped structure formed by three axially elongated tubular frame members joined for pivotal movement relative to each other by elbow pivot fittings 74 and 76. The sling support frame members include a cross member 78 and two generally upright side members 80 and 82. The free lower ends of the upright members 80 and 82 are releasably secured in plugging engagement within the complementary sockets 54, 54 formed in the elbow fittings 52, 52 which comprise the front cross member 40. The pivot axes of the elbow pivot fittings 74 and 76 are offset relative to each other so that the sling front supporting member 72 may be folded to a position wherein the three members 78, 80 and 82 are disposed in side-by-side parallel relation to each other when the sling front supporting member 72 is separated from the front cross member 40 and is folded to its break down condition, shown in FIG. 14.

The panel or sling 14 may be fabricated from any suitable flexible sheet material, a durable light-weight woven fabric being presently preferred. The panel 14 is generally rectangular and hemmed at its opposite ends, substantially as shown in the drawings. The hem at the front end of the chair receives the cross member 78 therethrough. A window in the underside of the panel 14 opens through a central portion of the rear hem to accommodate the stem on the panel upper support member 68. The tubular panel support members 77, 77 are received within the outer portions of the hem at the upper end of the panel, that is the portions of the hem outward of the window. The manner in which the upper end of the panel is supported by the panel upper support member 68 will be apparent from the further description which follows.

Figure 2:
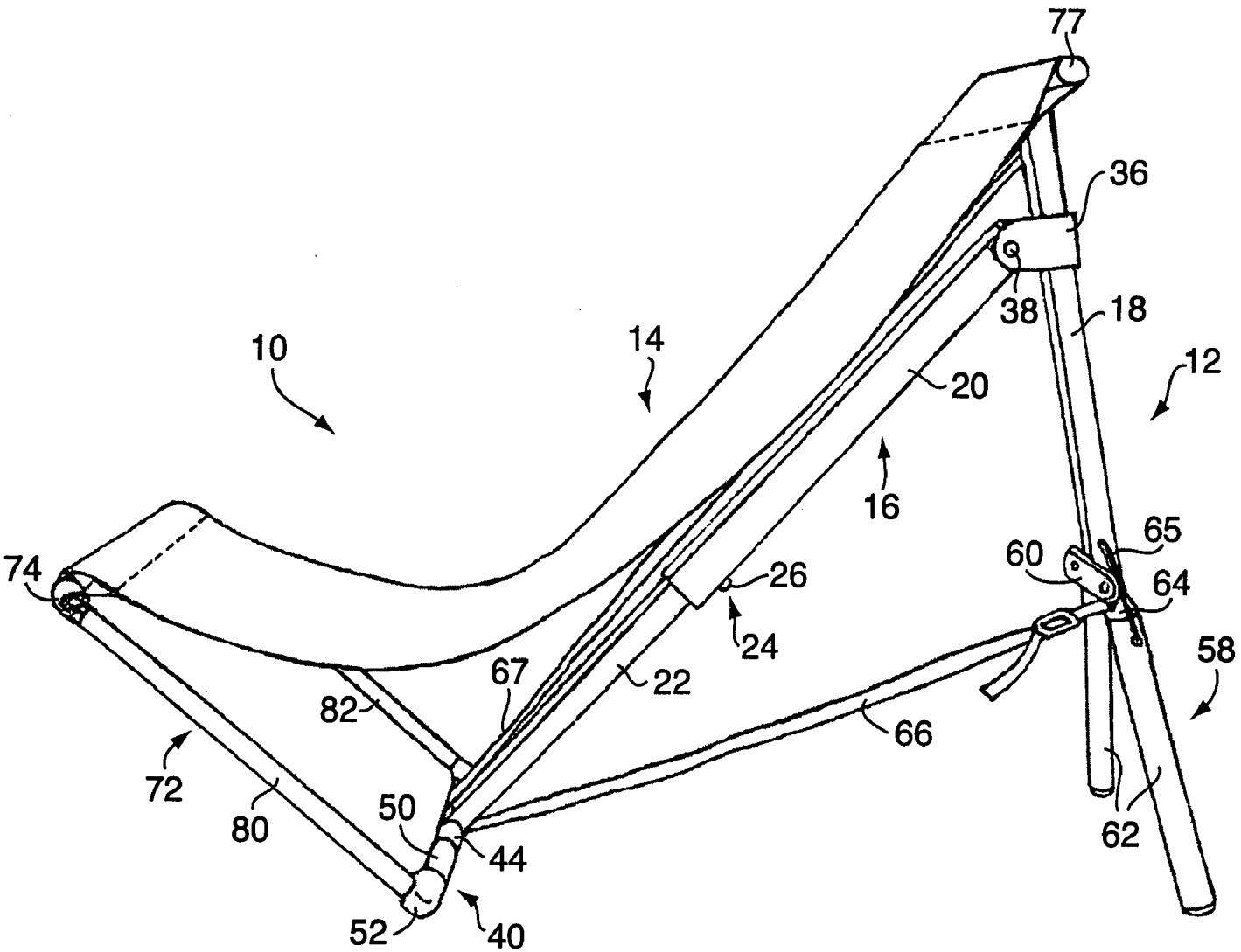
FIG. 2 is another perspective view of the portable sling chair of FIG. 1.

When the chair 10 is resting on a generally horizontal supporting surface in its setup condition, as it appears in FIGS. 1 and 2 the rear frame member 18 extends upwardly and is slightly forwardly inclined from the vertical and the single main frame member 16 is upwardly and rearwardly inclined, as best shown in FIG. 2. The chair frame 12 is maintained in static position by the flexible connecting member or strap 66 and may be further retained in the latter position by the flexible connecting member or strap 67, if such a member is also provided. In setup condition, the panel or sling 14, which is supported at its opposite ends by the sling front supporting member 72 and the upper sling supporting member 68 is loosely draped on the frame between the latter two members and assumes a generally arcuate position, best shown the generally side elevational view of in FIG. 2. In the latter position, the panel or sling 14 defines contiguous seat and back portions of the chair 10, indicated respectively at 86 and 88, FIG. 1. Thus, the chair enables a user to assume a reclining position and provides ample back support to assure comfort. The sling front supporting member 72, supported on the front cross member 40, is pivotally movable relative to the main frame member 16 and about the axis of the front cross member 40, the inner ends of the front section members 50, 50 being slidably received in and free to rotate relative to the laterally outwardly open sockets 47, 47 in the cross head. A user may change his or her position on the chair by grasping laterally opposite side portions of the sling 14 while shifting his body position slightly relative to the sling.

When the chair 10 is not in use, it may be placed in its collapsed or break down condition for portage or storage, as desired.

Considering now the collapsed condition of the various rigid elongated frame members which comprise the chair frame 12 and referring first particularly to FIG. 3 wherein the chair frame 12 is shown with the sling 14 and the sling front support member 72 removed. The sling front panel support member 72 is separated from the frame by unplugging the lower ends of the inverted generally "U" shaped sling front support member 72 from the sockets 54, 54 in the elbow fittings 52, 52 at the outer ends of the front cross member 40. The panel 14 may be separated from the rear upper support member by collapsing the latter support member as will be hereinafter further discussed or, if desired, the panel or sling 14 may remain connected to the frame structure by the upper support member in its collapsed condition. However, for clarity of illustration the chair frame 12 is hereinafter shown and further described as it appears after the panel 14 has been separated therefrom.

The legs 62, 62 on the rear frame member 18 are moved to collapsed condition by an applying a downwardly directed force to each leg 62 in opposition to the light tension of the bungee cord 65 to position the pivot pin 63 which supports each leg in the upper end of the slot in the leg connecting fitting associated with that leg (See FIG. 10). From this position, each leg 62 may be pivoted upwardly and inwardly toward an associated side of the rear frame member 18. When a leg is in the latter position, the bungee cord no longer exerts influence upon the leg which is then free to travel in a limited downward direction so that the pivot pin associated with the leg is disposed at the upper end of the now inverted slot in the leg connecting fitting. Thus gravity and the geometry of the legs cooperate to retain the rear legs in the collapsed condition adjacent opposite sides of the rear frame member 18.

The main frame member 16 is collapsed or moved to its retracted position by manually operating the detent button 26 to release the smaller section of the main frame member 16 so that it may be moved to its fully retracted position within the larger of the two main frame sections.

The front cross member 40 is collapsed by applying pulling force in an axial laterally outward direction on each of the cross member sections 50 in opposition to the biasing force exerted by the bungee cord 56 to disengage each section member 50 from it associated socket 47. Each cross member section 50 is then moved to a collapsed position laterally adjacent and axially parallel to the forward end portion of the collapsed main frame member 16. The portion of the bungee cord 56 associated with each cross member 50 will enter an associated slot 48 in an outwardly extending portion of the tee fitting to seat the cross member section on the tee fitting. Biasing force exerted by the bungee cord 56 will retain the cross member sections 50, 50 in collapsed positions seated on the tee fitting 42 (FIG. 9). The manually operable detent button which releasably secures the collar 36 in its predetermined setup position on the rear frame member 16 is released to allow the collar to be slidably moved upwardly along the rear frame member 18 and to a position immediately below the sling upper support member 68. The retracted main frame member 16 is then pivoted about an axis defined by the pivot pin 38 on the collar 36 and slidably moved upwardly on the rear frame member 18 to its collapsed position wherein it is disposed adjacent the rear frame member 18 and in axially parallel relation to it.

The upper sling support member is substantially identical in most respects to the front cross member 40 and is collapsed in the manner previously described with reference to the front cross member. Slots in the upper tee fitting are positioned to allow the upper cross section members to be moved to collapsed positions adjacent laterally opposite sides of the collar 36 in which collapsed positions the sections are retained in seated positions on the upper tee fitting by cooperation of bungee cord within the section members thereof as hereinbefore described with reference to the front cross member.

Figure 14:
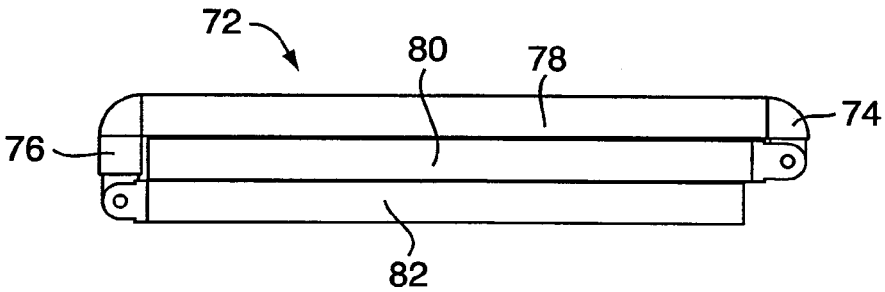
FIG. 14 shows the front sling support member in collapsed condition.

If the sling 14 is separated from the chair frame 12, the front sling support member may be folded to the collapsed condition shown in FIG. 14. Thereafter, the sling 14 may be wrapped around the front sling support member and positioned adjacent and in parallel relation to the knocked down or collapsed chair frame 12 to form a compact bundle wherein all of the rigid members which comprise the chair frame 12 generally extend in a single longitudinal direction and are generally in side-by-side relation to each other to form a compact bundle. The resulting bundle may be placed in a carrying pouch (not shown) suitable for storage in one of the many small compartments provided in a sport utility vehicle or may be carried in a canoe or a kayak, for example. The compact light-weight bundle which comprises the chair 10 may also be conveniently carried in a backpack worn by a camper, biker or hiker.

Referring further to the drawings and particularly FIGS. 15 through 19, another portable sling chair embodying the present invention is indicated generally by the reference number 10*a*. The chair 10*a* is similar, in many respects to the previously described chair 10 and parts of the chair 10*a* which are identical to previously described parts of the chair 10 bear the same reference numerals with a letter "a" suffix and will not be hereinafter discussed in detail. Specifically, the front cross member 40*a*, the sling front supporting member 72*a*, the rear or upper sling supporting member 68*a* and the sling 14*a* are substantially identical to the corresponding components of the previously described portable sling chair 10. The chair 10*a* differs from the previously described chair in the construction and arrangement of the rear supporting legs, the manner in which the main frame member 16 cooperates with the rear support member 18 and the construction and arrangement of the connecting members which stabilize the structure in its set-up position. These differences will now be described.

The collar 36*a* which connects the main frame member 16*a* to the rear frame member 18*a* is supporting on the rear frame member for limited sliding movement on only an upper portion of the rear frame member 18*a*. A stop 90 threadably into the rear frame member 18*a* and projecting outwardly therefrom in the downward path of the sliding collar 36*a* limits the downward travel of the collar from its uppermost position adjacent the under surface of the upper sling supporting member 68*a*.

A generally horizontally disposed leg spreader 92 mounted in fixed position on the lower end of the rear frame member 18*a* projects laterally outwardly in opposite directions beyond the side surfaces of the rear frame member and defines downwardly and laterally outwardly inclined leg engaging surfaces 94, 94 for a purpose which will be hereinafter evident.

The rear leg assembly includes a leg supporting collar 96 supported on the rear frame member 18*a* for sliding movement therealong between the leg spreader 92 and the main frame supporting collar 36*a*. The collar 96 has a rectangular bore which generally complements the cross sectional configuration of the rear support member which extends through it. A clearance slot opens into the bore 98 and extends axially of the bore to provide clearance for the stop 90 carried by the rear frame member 18*a*. A pair of yokes formed by the leg support collar 96 open laterally outwardly at opposite sides of the collar and receive a pair of legs 102, 102 therein. The legs 102, 102 are preferably cylindrical tubular members and each leg has a plug fitting 104 mounted in it upper end and projecting therefrom. Each leg may also be provided with a ground engaging foot fitting if desired. Each leg is supported within an associated yoke of the leg collar by a pivot pin which supports the leg for pivotal movement within and relative to the leg support collar 96.

The leg support collar 96 defines a rearwardly open central aperture 110 for receiving a detent button 26*a* which projects rearwardly from and forms a part of a detent button assembly 24*a* carried by the rear frame member 18*a* and located above and in close proximity to the leg spreader 96.

When the leg assembly is disposed in its lowermost or setup position, the detent button 26*a* is engaged within the aperture 110 so that the legs are deployed by and retained in fully deployed position by the leg spreader 92. In the latter position of the legs, each leg plug is disposed in abutting engagement with an associated side of the rear frame member 18*a*. Preferably, and as shown, the leg assembly further includes a flexible leg retaining member or strap 112 which is pinned at its opposite ends to and extends between central portions of the legs to aid in preventing leg splaying when the chair is occupied by an unusually heavy person.

The chair 10*a* further differs from the chair 10 in that it has a rigid connecting member as well as at least one flexible connecting member. More specifically, the chair frame includes a rigid connecting member 114 which is pivotally connected to and extends between a forward end portion of the main frame section 20*a* and the leg support collar 96. The rigid member 114 preferably comprises an upwardly open channel member which has a lower wall and a pair of opposing side walls defining a generally U-shaped cross sectional configuration. The channel is sized to substantially receive the main frame member section 20*a* therein. Forward extensions of the channel side walls are individually pivotally connected to the associated side walls of the main frame member first section 20*a*. This arrangement provides for the unimpeded telescopic reception of the main frame member second section 22*a* within the main frame member first section 20*a*.

The rear end of the channel member 114 is connected by a pivot pin 116 to a forwardly open yoke integrally formed on the leg support collar 96. Flexible connecting members 118, 118, preferably straps, provide connection between the outer ends of the pivot pin 116 and the pivot pin 38*a* which connects the main frame collar 36*a* to the rear end of the main frame member 16*a*. The straps 118, 118 maintain the collar 36*a* in general engagement with the stop 90 when the leg assembly is in its deployed position with the detent button 26*a* engaged with the leg support collar 96 within the aperture 110.

Figure 20:
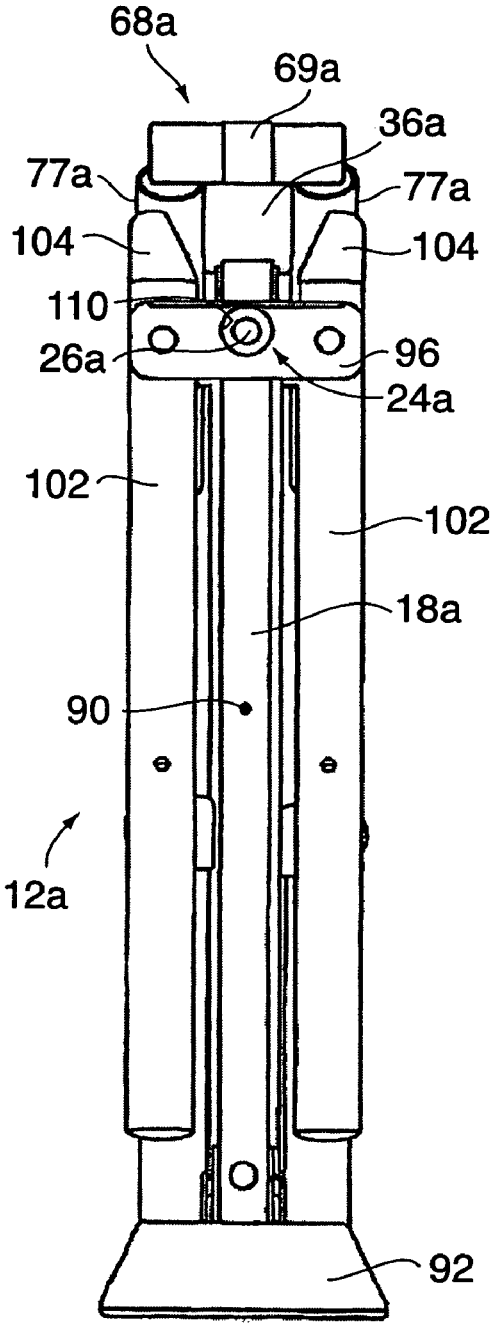
FIG. 20 is a somewhat enlarged rear elevational view of the chair frame of FIG. 15 shown in its fully knocked down condition.
Figure 21:
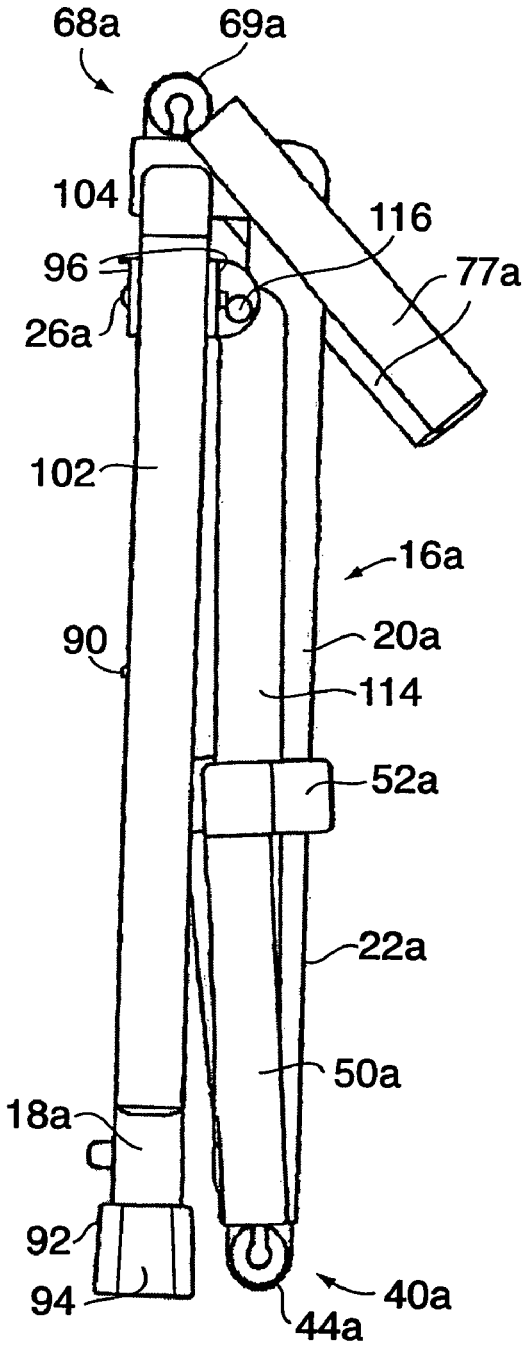
FIG. 21 is a side elevational view of the chair frame a shown in FIG. 20.
Figure 22:
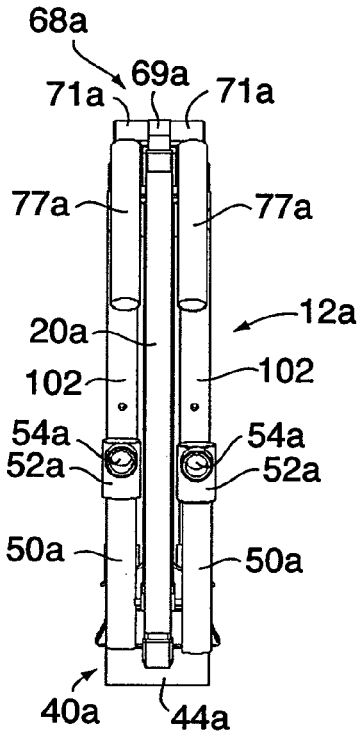
FIGS. 22–25 illustrate successive steps in setting up the chair frame of FIG. 15.
Figure 23:
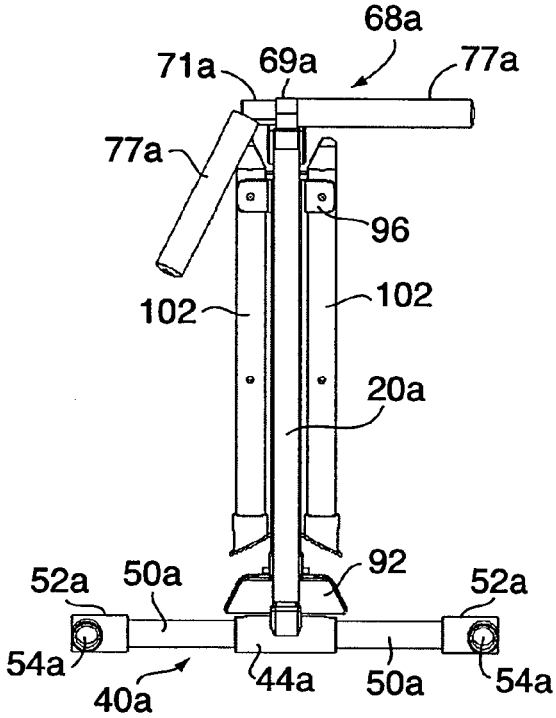
Figure 24:
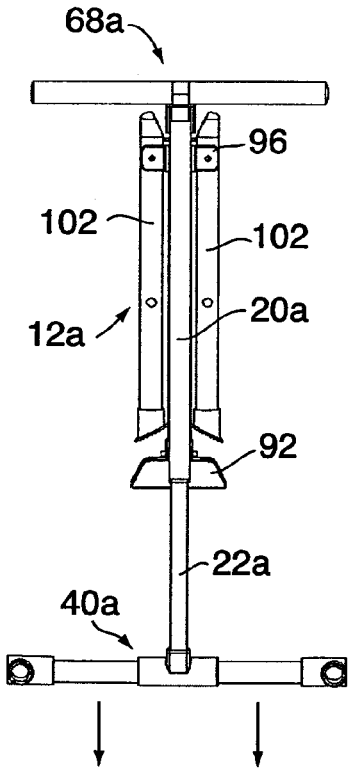

The procedure for erecting the chair frame 12*a* from its broken down to its setup condition is a relatively simple, four-step process illustrated by FIGS. 22 through 25. In FIGS. 20 and 21, the chair frame 12*a* is shown in its break down condition that is the condition in which it is separated from the panel 14*a* and its supporting frame 72*a*. When the frame 12*a* is in its break-down condition, all of the collapsible components which comprise the frame are in collapsed condition. Before beginning assembly, the frame should be oriented with the collapsed front support member 40*a* and the collapsed panel upper support member 68*a* facing in the direction of the assembler, as the frame 12*a* appears in FIG. 22. The next step in the assembly process is to extend the four section members which comprise the front cross member 40*a* and the sling upper support member 78*a* in laterally outward directions and onto the tee fittings which support them (FIG. 23).

Figure 25:
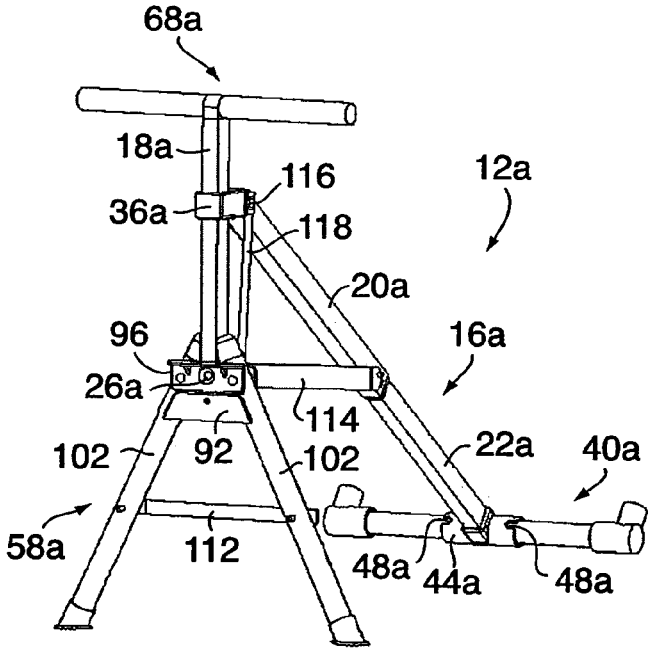
Figure 26:
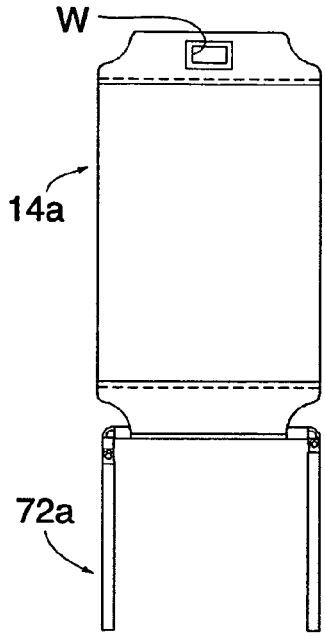
FIGS. 26–29 illustrate successive steps in mounting the sling assembly on the setup chair frame.
Figure 27:
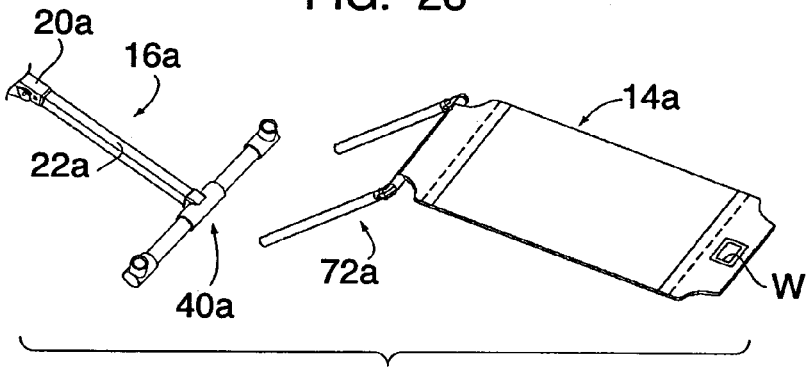

Thereafter, the main support member is telescopically extended by pulling the front cross member 40*a* downwardly relative to the sling upper support member 68*a* to engage the detent button 26*a* carried by the main frame member second section 22*a* in the aperture formed in the main frame member first section 20*a* whereby the main frame member 16*a* will be releasably secured in its extended position. The final step in assembly of the frame is shown in FIG. 25. The leg assembly and leg support collar 96 are drawn downwardly in sliding relation to the rear frame member 18*a* to engage the detent button 26*a* carried by the rear frame member in the aperture formed in the leg support collar 96 and cause the leg spreader 92 to deploy the legs in supporting position. The flexible connecting members will simultaneously lower the main frame support collar 36*a* and the rigid connecting member will simultaneously pivot the main frame member to its setup position. The frame 12*a* will now be in its setup position of FIG. 25.

Figure 15:
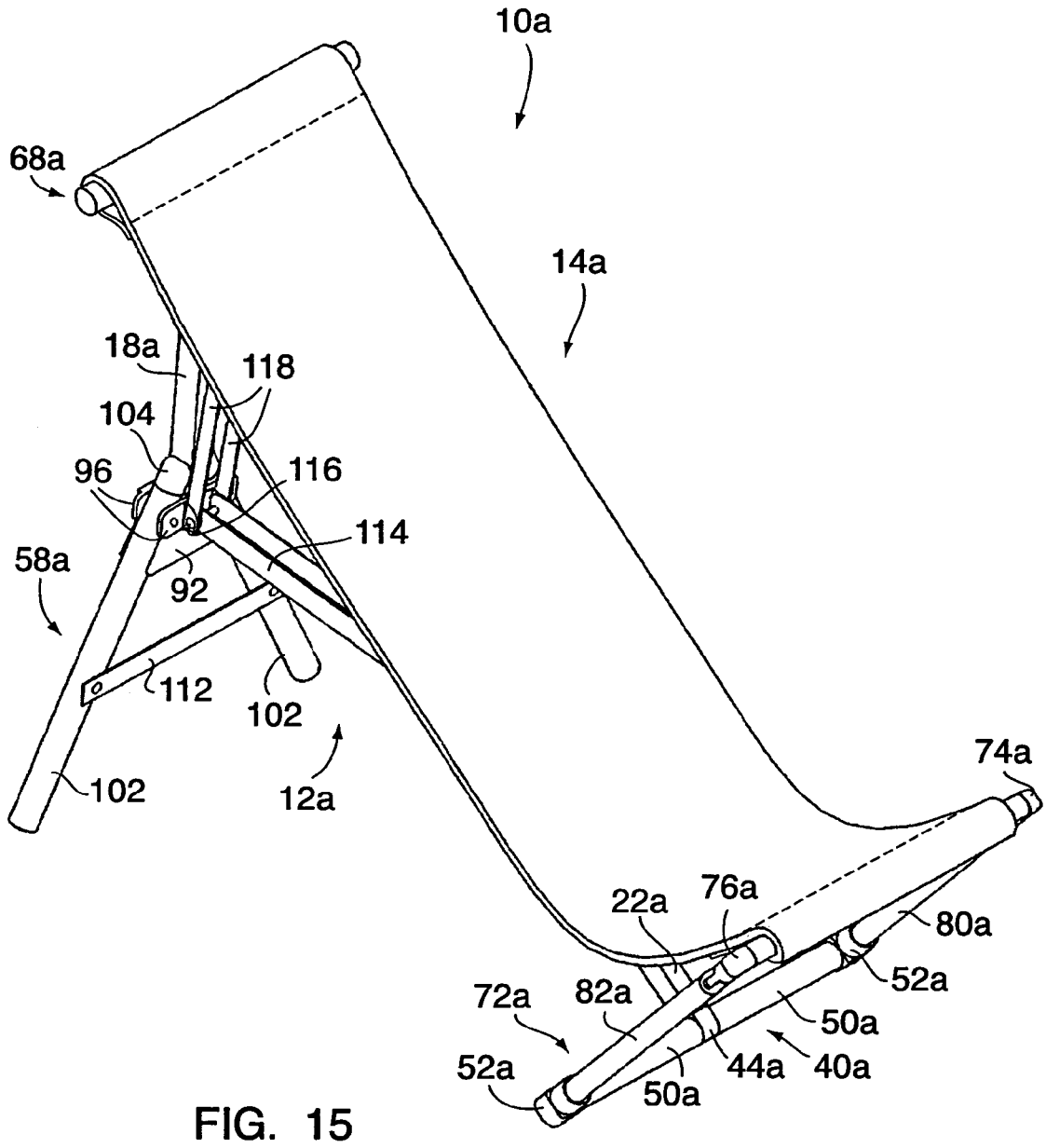
FIG. 15 is a perspective view of another sling chair embodying the invention.
Figure 16:
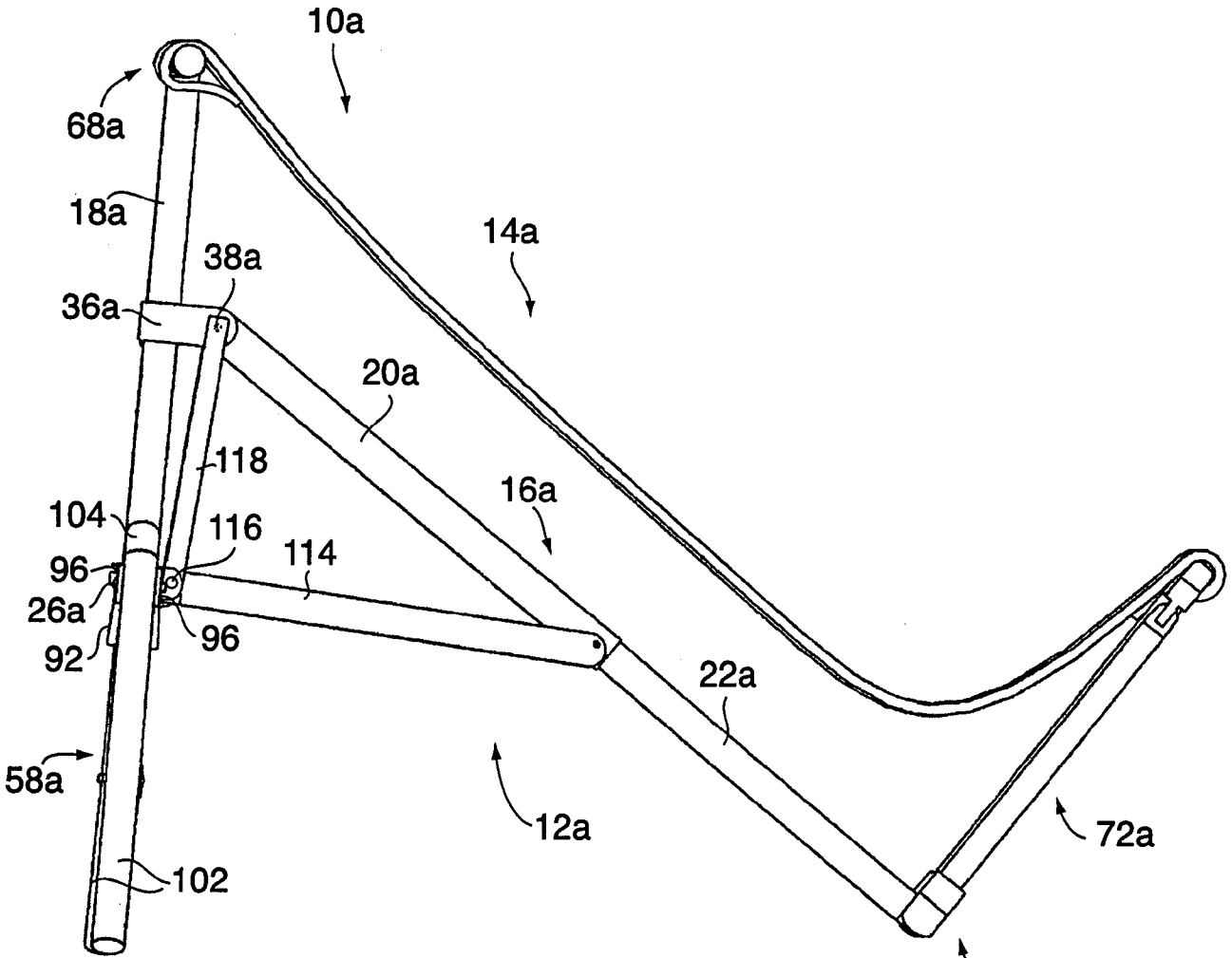
FIG. 16 is a side elevational view of the chair of FIG. 15.
Figure 17:
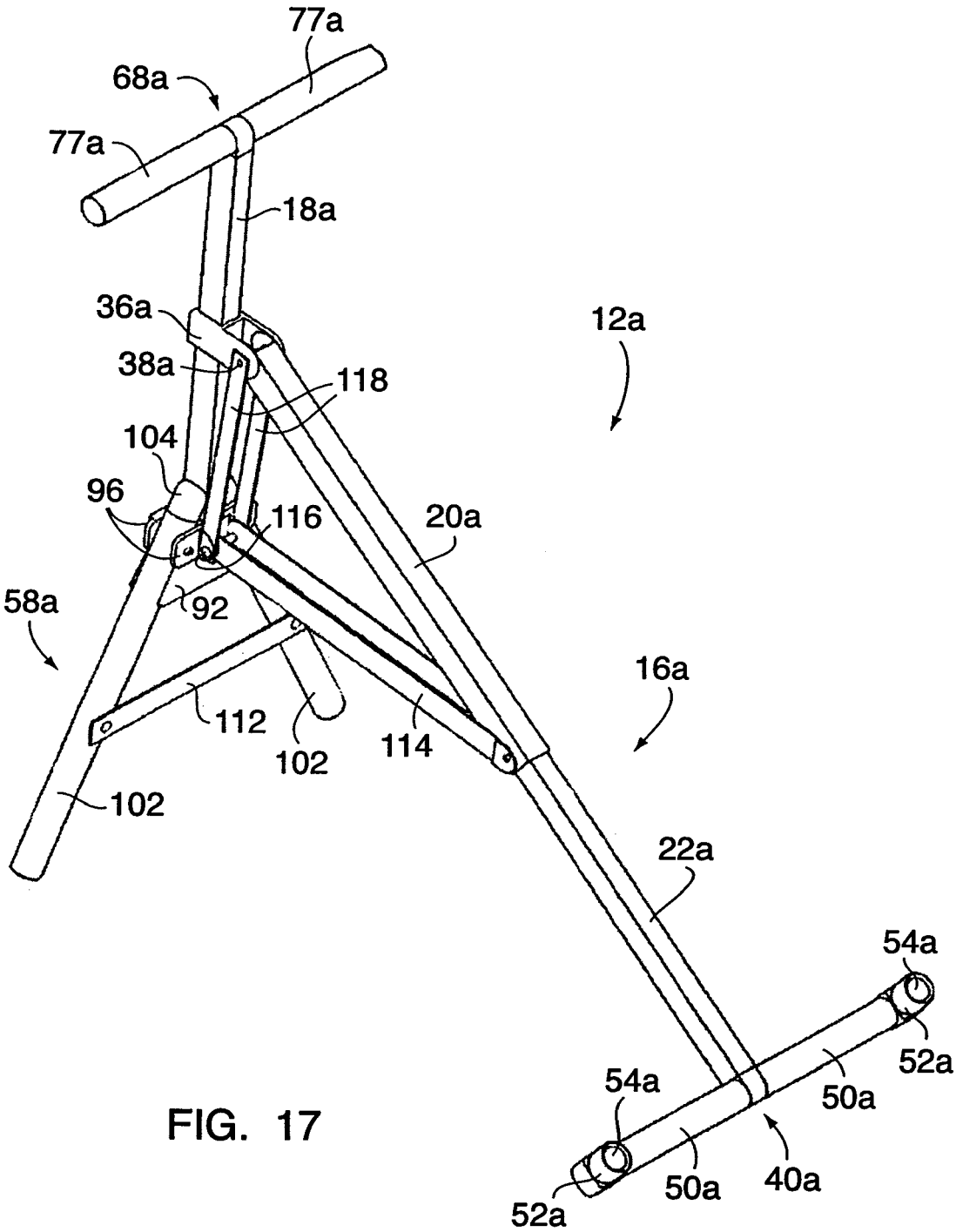
FIG. 17 is a perspective view of the chair frame shown with the sling and front sling support member removed.
Figure 18:
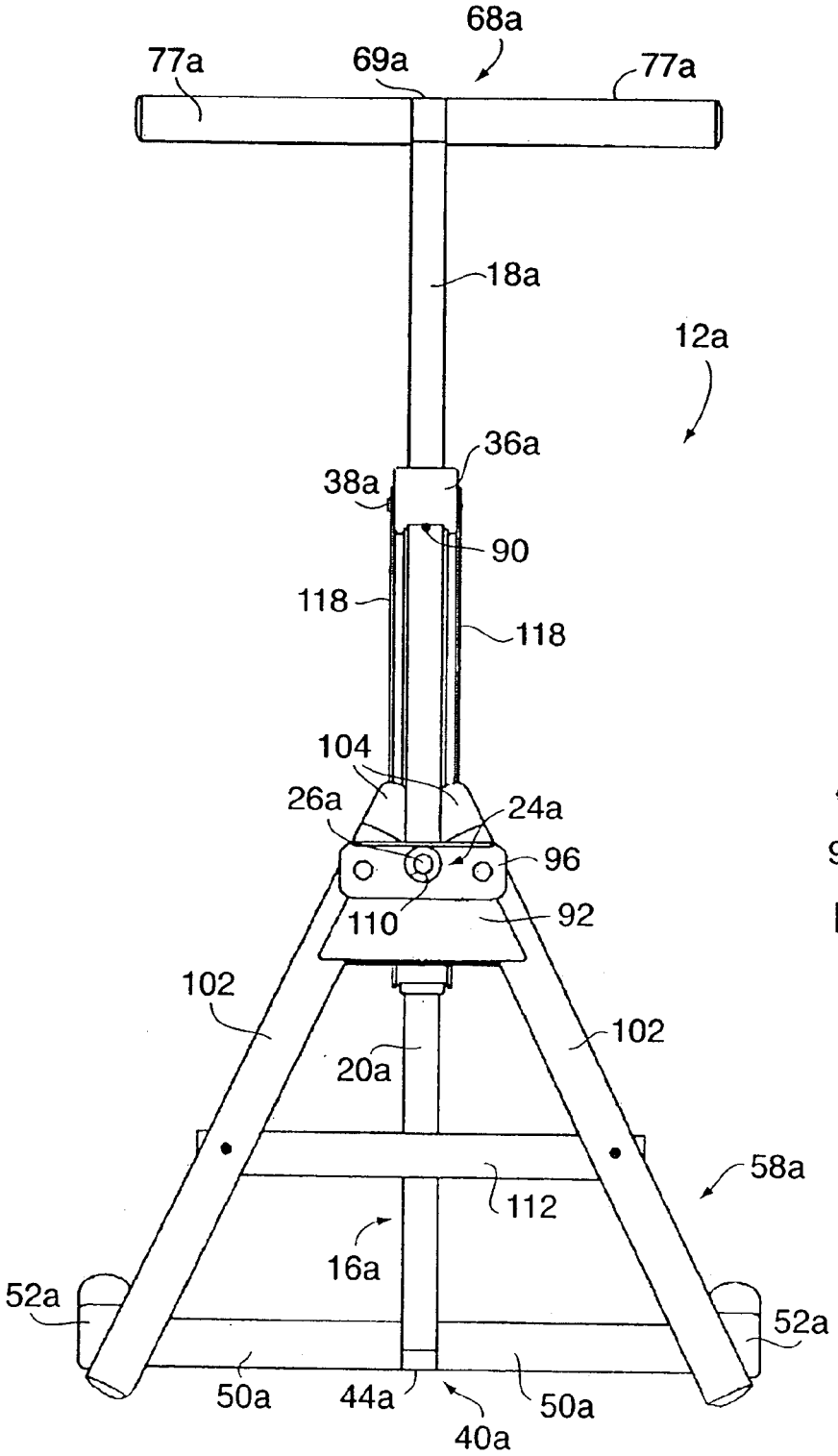
FIG. 18 is a rear elevational view of the chair of FIG. 15.
Figure 19:
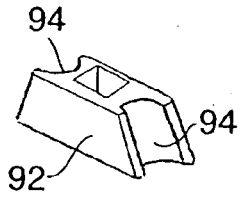
FIG. 19 is a perspective view of the leg spreader
Figure 28:
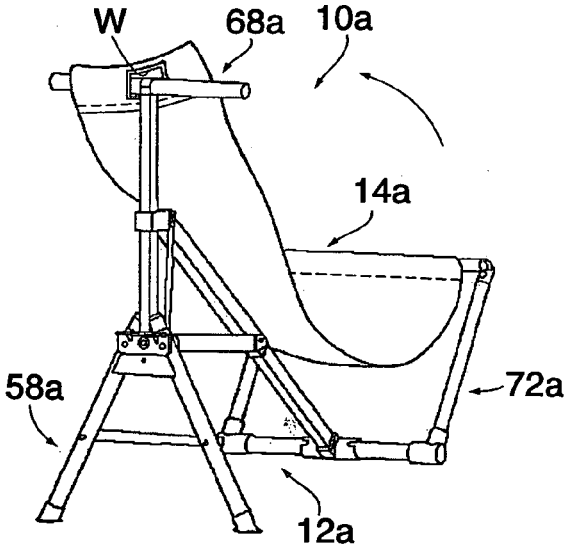
Figure 29:
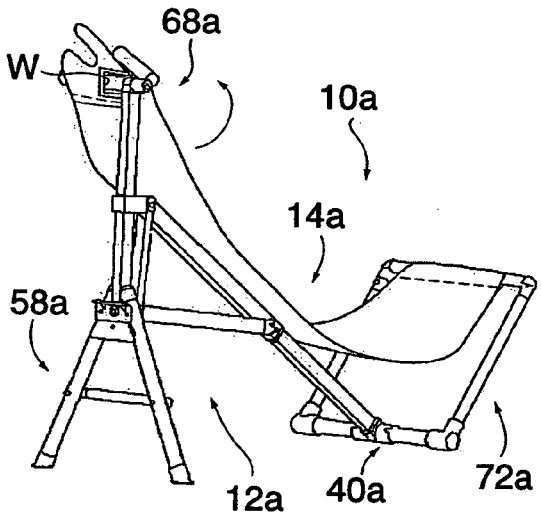

Set up is completed by assembling the panel 14*a* and the front panel support member 72*a* with the frame 12*a*. The panel 14*a* is unrolled from the panel support frame with the window, indicated by the letter W facing in an upward direction. The free ends of the U-shaped sling front support member 72*a* is next positioned in the sockets 54*a*, 54*a* at the outer ends of the front cross member 40*a*. The flexible panel 14*a* is then rotated from its position in FIG. 28 to its position of FIG. 29 as indicated by the directional arrows in the latter figures. One of the projecting support sections is next inserted into the upper hem through the window W. The other half of the upper hem is then folded to expose the opposite side of the window W above the already engaged portion of the hem. The opposite end of the sling upper support member is then disengaged from the tee fitting, inserted into the other or unoccupied half of the hem and re-engaged with the tee fitting to complete the portable chair assembly. The chair 10*a* should now appear as shown in FIGS. 15 and 16.

What is claimed is:

1. A portable sling chair comprising; a chair frame having setup and collapsed conditions and including a plurality of axially elongated rigid frame members, said frame members including a single main frame member and a rear frame member, a first connecting fitting securing a rear end of said main frame member to said rear frame member for pivotal movement of said main frame member toward and away from said rear frame member and for movement longitudinally along said rear frame member, connecting means for releasably securing said first connecting fitting in a fixed setup position on said rear frame member with said first connecting fitting longitudinally downwardly spaced from an upper end of said rear frame member to secure said chair frame in said setup condition wherein said rear frame member is upwardly and forwardly inclined and said main frame member is rearwardly and upwardly inclined when said chair is resting on a generally horizontal supporting surface in said setup condition, an axially elongated connecting element connected to said main frame member and said rear frame member and restraining said main frame member against pivotal movement away from said rear frame member when said chair is in said setup condition, and a flexible panel supported on said chair frame at the upper end of said rear frame member and at the forward end of said main frame member and above said main frame member, said panel defining contiguous chair seat and back portions.

2. A portable sling chair as set forth in claim 1 wherein said first connecting fitting is received and supported on said rear frame member for sliding movement longitudinally therealong and said main frame member is pivotally connected to said first connecting fitting.

3. A portable sling chair as set forth in claim 2 wherein said rear frame member has a non-circular cross section and said first connecting fitting comprises a collar complimenting said non-circular cross section.

4. A portable sling chair as set forth in claim 1 wherein said connecting element is disposed below said main frame member when said chair is in said set up condition.

5. A portable sling chair as set forth in claim 4 wherein said connecting element comprises a flexible element.

6. A portable sling chair as set forth in claim 5 wherein said flexible connecting element comprises a strap having an adjustable length.

7. A portable sling chair as set forth in claim 1 wherein said connecting element comprises a rigid element.

8. A portable sling chair as set forth in claim 7 wherein said connecting element is disposed below said main frame member when said chair is in said setup condition.

9. A portable sling chair as set forth in claim 7 wherein said rigid element comprises a channel member having a generally U-shaped channel receiving therein a portion of one of said members comprising said main frame member and said rear frame member when said chair frame is in said collapsed condition.

10. A portable sling chair as set forth in claim 9 wherein said one of said members comprises said main frame member.

11. A portable sling chair a set forth in claim 1 wherein said main frame member comprises first and second tubular frame sections and said second frame section is telescopically movable into said first frame section and to a retracted position therein and out of said first frame section and to an extended position wherein said second frame section projects a substantial distance from and beyond said first frame section.

12. A portable sling chair as set forth in claim 11 wherein both said first and second tubular frame sections have non-circular cross sections.

13. A portable sling chair as set forth in claim 11 wherein said main frame member includes a detent button assembly carried by said second frame section for releasably locking said frame sections in said extended position when said chair is in said setup condition.

14. A portable sling chair as set forth in claim 13 wherein said second frame section has a sidewall defining tube bore and having a first opening therethrough and a second opening in said sidewall generally opposite said first opening and communicating with said tube bore, and said detent button assembly includes a spring housing having a spring housing bore and adapted to be received within said tube bore with the axis of said spring housing bore extending generally transversely of the axis of said tube bore and between said first and second openings, a detent button slidably received within and projecting from one end of said spring housing for projecting outwardly through said first opening and beyond said sidewall to a detaining position, an end cap slidably received within another end of said spring housing opposite said one end and having a projection on an outer end thereof for engaging said sidewall within said second opening and a spring received within said spring housing bore between said detent button and said end cap and biasing said button and said end cap in opposite directions relative to said spring housing.

15. A portable sling chair as set forth in claim 13 wherein said tube bore is non-cylindrical and said spring housing complements an associated portion of said tube bore.

16. A portable sling chair as set forth in claim 1 wherein said chair frame has a collapsible rear support assembly including a pair of rear legs supported on said rear frame member for movement between a deployed position wherein said rear legs are laterally outwardly and downwardly inclined from opposite sides of said rear frame member and a collapsed position wherein said rear legs are disposed generally adjacent said rear frame member and generally parallel thereto.

17. A portable sling chair as set forth in claim 16 wherein said rear legs are supported for movement along and pivotal movement relative to said rear frame member between said deployed and collapsed positions.

18. A portable sling chair as set forth in claim 16 wherein said rear legs in said collapsed position extend generally toward an upper end of said rear frame member.

19. A portable sling chair a set forth in claim 16 wherein said rear support assembly includes an elastomeric cord for releasably retaining said rear legs in either said deployed position or said collapsed position.

20. A portable sling chair as set forth in claim 1 wherein said chair frame has a collapsible support assembly including a pair of section members each projecting laterally outwardly from an associated side of an associated one of said members including said main frame member and said rear frame member when said chair frame is in its setup condition and being disposed in adjacent side-by-side parallel relation to said associated one of said members when said chair frame is in said collapsed condition.

21. A portable sling chair as set forth in claim 20 wherein said support assembly includes an elastomeric cord for releasably retaining said section members in either said setup or said collapsed condition.

22. A portable sling chair comprising; a chair frame having setup and collapsed conditions and including a plurality of axially elongated rigid frame members, said frame members including only one main frame member and a rear frame member, a frame support collar received on said rear frame member for axial movement in the one and opposite direction therealong, said main frame member having a rear end portion pivotally connected to said frame support collar and supporting said main frame member for pivotal movement toward and away from said rear frame member, means for releasably securing said frame support collar in a fixed setup position on said rear frame member downwardly spaced from the upper end of said rear frame member wherein said rear frame member is upwardly and forwardly inclined and said main frame member is rearwardly and upwardly inclined when said chair is resting on a generally horizontal supporting surface in said setup condition, means for restraining said main frame member against pivotal movement away from said rear frame member when said chair is in said setup condition, and a flexible panel supported on said chair frame at the upper end of said rear frame member and at the forward end of said main frame member and above said main frame member, said panel defining contiguous chair seat and back portions.

23. A portable sling chair as set forth in claim 22 wherein said chair frame includes a pair of rear legs pivotally supported on a lower end portion of said rear frame member for movement between a deployed position wherein said legs are downwardly and outwardly inclined from said rear frame member and a collapsed position wherein said legs are disposed in adjacent parallel relation to opposite sides of said rear frame member.

24. A portable sling chair as set forth in claim 22 wherein said chair includes means for releasably holding said legs in said deployed position and in said collapsed position.

25. A portable sling chair as set forth in claim 24 wherein said releasably holding means comprises an elastomeric cord connected to and extending between said legs.

* * * * *

UNITED STATES PATENT AND TRADEMARK OFFICE

CERTIFICATE OF CORRECTION

PATENT NO. : 7,240,961 B2
APPLICATION NO. : 11/203795
DATED : July 10, 2007
INVENTOR(S) : Daniel R. Grace It is certified that error appears in the above-identified patent and that said Letters Patent is hereby corrected as shown below:

Column 11, line 60, please delete “a” and insert -- as --.

Column 12, line 48, please delete “a” and insert -- as --.

Signed and Sealed this

Twenty-eighth Day of August, 2007

JON W. DUDAS
*Director of the United States Patent and Trademark Office*